US011513450B2

(12) United States Patent
Nakamura

(10) Patent No.: US 11,513,450 B2
(45) Date of Patent: Nov. 29, 2022

(54) IMAGE FORMING APPARATUS

(71) Applicant: CANON KABUSHIKI KAISHA, Tokyo (JP)

(72) Inventor: Shuichi Nakamura, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/665,254

(22) Filed: Feb. 4, 2022

(65) Prior Publication Data

US 2022/0269191 A1 Aug. 25, 2022

(30) Foreign Application Priority Data

Feb. 22, 2021 (JP) ..... JP2021-026293

(51) Int. Cl.
*G03G 15/04* (2006.01)

(52) U.S. Cl.
CPC ..... *G03G 15/04072* (2013.01); *G03G 2215/00071* (2013.01); *G03G 2215/0404* (2013.01)

(58) Field of Classification Search
CPC ... G03G 15/04072; G03G 2215/00071; G03G 2215/0404
See application file for complete search history.

(56) References Cited

U.S. PATENT DOCUMENTS

2012/0224162 A1* 9/2012 Yokoi ..... G03G 15/04054 355/67
2018/0239284 A1* 8/2018 Shoji ..... G03G 15/5025

FOREIGN PATENT DOCUMENTS

JP 61277258 A * 12/1986
JP 2013029667 A * 2/2013
JP 2020-131575 8/2020

* cited by examiner

*Primary Examiner* — Susan S Lee
(74) *Attorney, Agent, or Firm* — Venable LLP

(57) ABSTRACT

An image forming apparatus includes: a photoconductor; an optical scanner configured to cause a plurality of light beams to scan simultaneously on a surface of the photoconductor; a pixel size calculator configured to calculate a pixel size corresponding to a scanning position of each of the light beams; a light-quantity value quantization converter configured to quantize a light-quantity value corresponding to the scanning position of each of the light beams; a storage configured to store conversion data for conversion from image density data into a light beam driving signal; a signal converter configured to perform, with the conversion data, conversion from the image density data into the light beam driving signal; a selector configured to select the conversion data, according to the pixel size calculator and the light-quantity value quantization converter; and a light source configured to emit the plurality of light beams, based on driving data obtained through conversion by a driving data converter with the conversion data selected by the selector, in which a number of pieces of the conversion data correspond to a number resulting from a number of obtainable pixel size values×a number of obtainable light-quantity quantized values×a number of light beams.

1 Claim, 16 Drawing Sheets

FIG 9

| (a) | | | (b) | | | (c) | | (d) |
|---|---|---|---|---|---|---|---|---|
| x | f(x) | f'(x) | CALCULATED SIZE VALUE | PIXEL SIZE | CALCULATION ERROR | g(x) | g'(x) | LIGHT-QUANTITY LEVEL |
| 0 | 1.3000E+00 | -5.9221E-05 | 110.8250 | 111 | -0.1750 | 7.0000E-01 | 1.3664E-04 | 0 |
| 1 | 1.2999E+00 | -5.9336E-05 | 110.6450 | 111 | -0.3550 | 7.0014E-01 | 1.3661E-04 | 0 |
| 2 | 1.2999E+00 | -5.9452E-05 | 110.4598 | 110 | 0.4598 | 7.0027E-01 | 1.3658E-04 | 0 |
| 3 | 1.2998E+00 | -5.9567E-05 | 111.2897 | 111 | 0.2897 | 7.0041E-01 | 1.3656E-04 | 0 |
| 4 | 1.2998E+00 | -5.9683E-05 | 111.0744 | 111 | 0.0744 | 7.0055E-01 | 1.3652E-04 | 0 |
| 5 | 1.2997E+00 | -5.9798E-05 | 110.8741 | 111 | -0.1259 | 7.0068E-01 | 1.3649E-04 | 0 |
| 6 | 1.2996E+00 | -5.9913E-05 | 110.6886 | 111 | -0.3114 | 7.0082E-01 | 1.3646E-04 | 0 |
| 7 | 1.2996E+00 | -6.0029E-05 | 110.4681 | 110 | 0.4681 | 7.0096E-01 | 1.3643E-04 | 0 |
| 8 | 1.2995E+00 | -6.0144E-05 | 111.2424 | 111 | 0.2424 | 7.0109E-01 | 1.3640E-04 | 0 |
| 9 | 1.2995E+00 | -6.0260E-05 | 111.0219 | 111 | 0.0219 | 7.0123E-01 | 1.3637E-04 | 0 |
| OMITTED | | | | | | | | |
| 2975 | 1.0604E+00 | -8.4744E-05 | 90.7827 | 91 | -0.2173 | 9.1719E-01 | 7.2668E-05 | 5 |
| 2976 | 1.0603E+00 | -8.4185E-05 | 91.1731 | 90 | 0.1731 | 9.1727E-01 | 7.2637E-05 | 5 |
| 2977 | 1.0602E+00 | -8.4128E-05 | 90.5563 | 91 | -0.4437 | 9.1734E-01 | 7.2607E-05 | 5 |
| 2978 | 1.0601E+00 | -8.4068E-05 | 91.0923 | 90 | -0.0977 | 9.1741E-01 | 7.2576E-05 | 5 |
| 2979 | 1.0600E+00 | -8.4009E-05 | 90.3012 | 90 | 0.3012 | 9.1748E-01 | 7.2545E-05 | 5 |
| 2980 | 1.0600E+00 | -8.3950E-05 | 90.6629 | 91 | -0.3371 | 9.1756E-01 | 7.2514E-05 | 5 |
| 2981 | 1.0599E+00 | -8.3891E-05 | 91.0174 | 90 | 0.0174 | 9.1763E-01 | 7.2483E-05 | 5 |
| 2982 | 1.0598E+00 | -8.3832E-05 | 90.3648 | 90 | 0.3648 | 9.1770E-01 | 7.2452E-05 | 5 |
| 2983 | 1.0597E+00 | -8.3774E-05 | 90.7051 | 91 | -0.2949 | 9.1777E-01 | 7.2422E-05 | 5 |
| 2984 | 1.0596E+00 | -8.3715E-05 | 91.0382 | 90 | 0.0382 | 9.1785E-01 | 7.2391E-05 | 5 |
| OMITTED | | | | | | | | |
| 4931 | 1.0569E+00 | 8.3715E-05 | 90.2685 | 90 | 0.2685 | 9.9803E-01 | -1.5388E-05 | 7 |
| 4932 | 1.0568E+00 | 8.3774E-05 | 90.6916 | 91 | -0.3084 | 9.9802E-01 | -1.5419E-05 | 7 |
| 4933 | 1.0567E+00 | 8.3832E-05 | 89.9418 | 90 | -0.0582 | 9.9800E-01 | -1.5450E-05 | 7 |
| 4934 | 1.0566E+00 | 8.3891E-05 | 90.2892 | 90 | 0.2892 | 9.9799E-01 | -1.5481E-05 | 7 |
| 4935 | 1.0565E+00 | 8.3950E-05 | 90.6438 | 91 | -0.3562 | 9.9797E-01 | -1.5511E-05 | 7 |
| 4936 | 1.0564E+00 | 8.4009E-05 | 90.0095 | 90 | 0.0095 | 9.9796E-01 | -1.5542E-05 | 7 |
| 4937 | 1.0563E+00 | 8.4068E-05 | 90.3743 | 90 | 0.3743 | 9.9794E-01 | -1.5573E-05 | 7 |
| 4938 | 1.0562E+00 | 8.4126E-05 | 90.7504 | 91 | -0.2496 | 9.9793E-01 | -1.5604E-05 | 7 |
| 4939 | 1.0561E+00 | 8.4185E-05 | 90.1336 | 90 | 0.1336 | 9.9791E-01 | -1.5635E-05 | 7 |
| 4940 | 1.0560E+00 | 8.4244E-05 | 90.5239 | 91 | -0.4761 | 9.9789E-01 | -1.5666E-05 | 7 |
| OMITTED | | | | | | | | |
| 7007 | 1.2998E+00 | 9.0144E-05 | 111.0642 | 111 | 0.0642 | 9.0168E-01 | -7.9396E-05 | 5 |
| 7008 | 1.2997E+00 | 9.0029E-05 | 110.8486 | 111 | -0.1514 | 9.0080E-01 | -7.9429E-05 | 5 |
| 7009 | 1.2996E+00 | 8.9913E-05 | 110.6380 | 111 | -0.3620 | 9.0062E-01 | -7.9457E-05 | 4 |
| 7010 | 1.2996E+00 | 8.9798E-05 | 110.4326 | 110 | 0.4326 | 9.0144E-01 | -7.9488E-05 | 5 |
| 7011 | 1.2995E+00 | 8.9683E-05 | 111.2322 | 111 | 0.2322 | 9.0038E-01 | -7.9519E-05 | 5 |
| 7012 | 1.2994E+00 | 8.9567E-05 | 111.0370 | 111 | 0.0370 | 9.0028E-01 | -7.9548E-05 | 4 |
| 7013 | 1.2993E+00 | 8.9452E-05 | 110.8468 | 111 | -0.1532 | 9.0020E-01 | -7.9580E-05 | 5 |
| 7014 | 1.2993E+00 | 8.9336E-05 | 110.6617 | 111 | -0.3383 | 9.0012E-01 | -7.9611E-05 | 5 |
| 7015 | 1.2992E+00 | 8.9221E-05 | 110.4817 | 110 | 0.4817 | 9.0008E-01 | -7.9642E-05 | 4 |
| 7016 | 1.2000E+00 | 8.9105E-05 | 111.3967 | 111 | 0.3967 | 8.9997E-01 | -7.9673E-05 | 5 |

FIG 11

| RANGE OF LIGHT-QUANTITY CORRECTION FACTOR | | |
|---|---|---|
| min | max | LIGHT-QUANTITY LEVEL |
| 0.7 | 0.7375 | 0 |
| 0.7375 | 0.775 | 1 |
| 0.775 | 0.8125 | 2 |
| 0.8125 | 0.85 | 3 |
| 0.85 | 0.8875 | 4 |
| 0.8875 | 0.925 | 5 |
| 0.925 | 0.9625 | 6 |
| 0.9625 | 1 | 7 |

IMAGE FORMING APPARATUS

BACKGROUND OF THE INVENTION

Field of the Invention

The present invention relates to an electrophotographic-system image forming apparatus, such as an electrophotographic copying machine and an electrophotographic printer.

Description of the Related Art

An electrophotographic-system image forming apparatus is equipped with an optical scanning unit (optical scanner) that irradiates the surface of a photoconductor with laser light, to form an electrostatic latent image. The optical scanning unit emits laser light, based on image data, such that the laser light reflects off a polygon mirror and passes through a scanning lens, so that the surface of the photoconductor is irradiated with the laser light, resulting in formation of an electrostatic latent image.

Here, as the scanning lens with which the optical scanning unit is provided, a scanning lens having an fθ characteristic has been widely known. The fθ characteristic is an optical characteristic that causes the laser light to form an image on the surface of the photoconductor such that the spot of the laser light moves at a constant velocity on the surface of the photoconductor while the polygon mirror is rotating at a constant angular velocity. Use of a scanning lens having an fθ characteristic enables constant exposure duration per pixel in the main scanning direction.

However, generally, a scanning lens having an fθ characteristic is large in size and high in cost. Therefore, Japanese Patent Application Laid-Open No. 2020-131575 discloses an image forming apparatus equipped with an optical scanning unit including no scanning lens or an optical scanning unit including a scanning lens having no fθ characteristic, achieving the image forming apparatus small in size and low in cost.

In addition, Japanese Patent Application Laid-Open No. 2020-131575 discloses that, in the optical scanning unit including no scanning lens or in the optical scanning unit including the scanning lens having no fθ characteristic, nonuniformity in image density is inhibited with correction of the exposure time of laser light for a constant pixel width on a photoconductor and further correction of the optical-path characteristic to the scanning position on the photoconductor based on image data.

According to Japanese Patent Application Laid-Open No. 2020-131575, partial scaling factor correction and partial light-quantity correction are performed according to the main scanning position on the photoconductor. This arrangement achieves correction of the quantity of laser light with image data due to independent partial scaling factor calculation and independent partial light-quantity calculation corresponding to the scanning position on the photoconductor. However, Japanese Patent Application Laid-Open No. 2020-131575 gives, for each of a plurality of beams of laser light different in optical-path characteristic, no specific description of how each optical-path characteristic is corrected at the main scanning position on the photoconductor.

It is desirable to provide an image forming apparatus that enables inhibition of nonuniformity in image density and includes an optical scanner that forms, with a plurality of beams of laser light, an electrostatic latent image on the surface of a photoconductor, in which the spots of the plurality of beams of laser light are variable in moving velocity on the surface of the photoconductor.

SUMMARY OF THE INVENTION

According to a representative aspect of the present invention, provided is an image forming apparatus including: a photoconductor; an optical scanner configured to cause laser light to scan on a surface of the photoconductor to form an electrostatic latent image, the optical scanner being configured to cause a plurality of beams of laser light to scan simultaneously on the surface of the photoconductor; a pixel size calculator configured to calculate a pixel size corresponding to a scanning position of the laser light on the surface of the photoconductor; a light-quantity value quantization converter configured to quantize a light-quantity value corresponding to the scanning position of the laser light on the surface of the photoconductor; a storage configured to store a plurality of pieces of conversion data for conversion from image density data into a laser light driving signal; a signal converter configured to perform, with the conversion data, conversion from the image density data into the laser light driving signal; and a selector configured to select the conversion data, according to the pixel size calculator and the light-quantity value quantization converter, in which the optical scanner includes a light source configured to emit the plurality of beams of laser light, based on driving data obtained through conversion by a driving data converter with the conversion data selected by the selector, and the storage stores the conversion data of which a number of pieces correspond to a number resulting from a number of obtainable pixel size values×a number of obtainable light-quantity quantized values×a number of beams of the laser light.

Further features of the present invention will become apparent from the following description of exemplary embodiments with reference to the attached drawings.

BRIEF DESCRIPTION OF THE DRAWINGS

FIG. 9 is a table of results of calculation in the image processing operation of the controller;

FIG. 11 is a table for level sorting in light-quantity correction amount;

DESCRIPTION OF THE EMBODIMENTS

First Embodiment

<Image Forming Apparatus>

The entire configuration of an image forming apparatus according to a first embodiment of the present invention will be described below together with the operation thereof at the time of image forming, with reference to the drawings. Note that, unless otherwise specified, the dimensions, material, and shape of each of the following constituent components and the relative arrangement thereof should not be construed to limit the scope of the invention.

The image forming apparatus A is of an intermediate tandem type that transfers four-color toners of yellow Y, magenta M, cyan C, and black K to an intermediate transfer belt and then transfers an image to a sheet, to form the image. Note that, in the following description, members that involve the yellow toner are denoted with Y as the suffix, members that involve the magenta toner are denoted with M as the suffix, members that involve the cyan toner are denoted with C as the suffix, and members that involve the black toner are denoted with K as the suffix. However, the configurations and operations of the members are substantially the same except for the colors of toner. Thus, the suffixes thereof will be appropriately omitted when no distinction is required.

Figure 1:
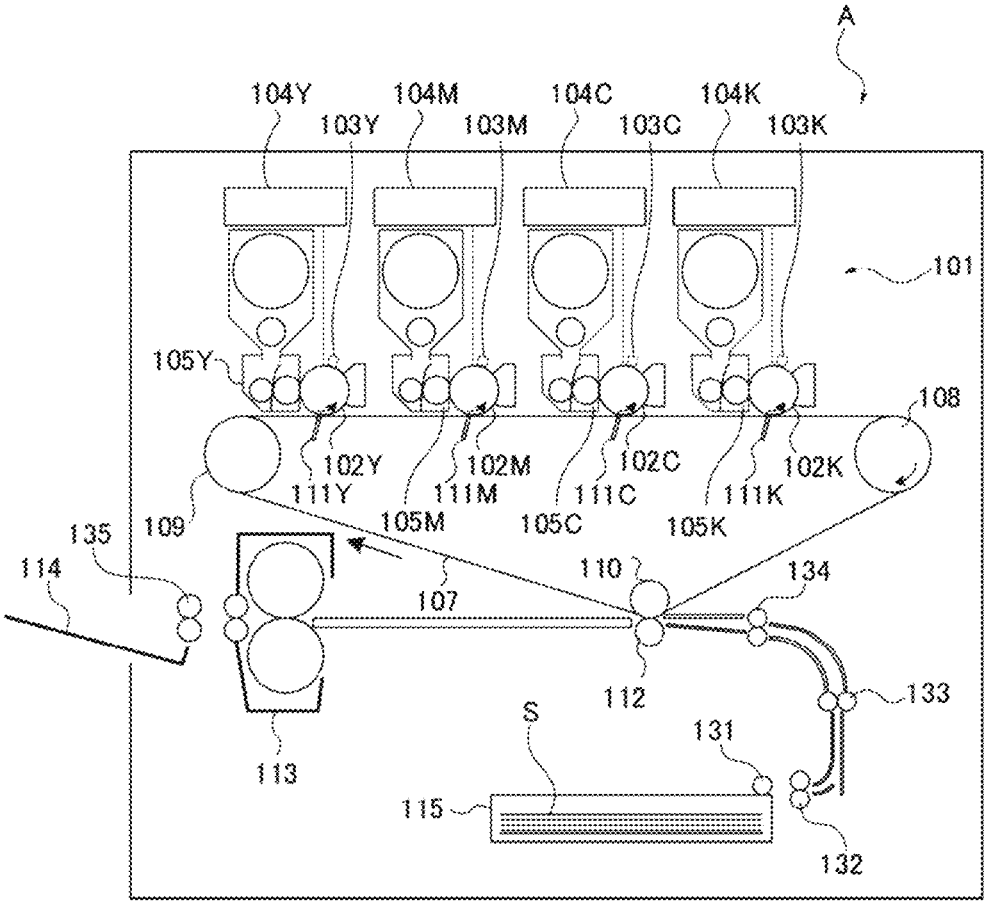
FIG. 1 is a schematic sectional view of an image forming apparatus.

FIG. 1 is a schematic sectional view of the image forming apparatus A. As illustrated in FIG. 1, the image forming apparatus A includes an image former 101 that forms a toner image and transfers the toner image to a sheet. The image former 101 includes photoconductive drums 102 (102Y, 102M, 102C, and 102K), charging units 103 (103Y, 103M, 103C, and 103K), and optical scanning units 104 (104Y, 104M, 104C, and 104K).

The image former 101 further includes developing units 105 (105Y, 105M, 105C, and 105K), primary transfer units 111(111Y, 111M, 111C, and 111K), and an intermediate transfer belt 107. The image former 101 further incudes a driving roller 108, a tension roller 109, a secondary transfer roller 112, and a secondary transfer counter roller 110. The intermediate transfer belt 107 runs circumferentially according to rotation of the driving roller 108.

Next, the image forming operation of the image forming apparatus A will be described. First, when an image forming job signal is input to a controller 208 illustrated in FIG. 2, a sheet S loaded and housed in a sheet cassette 115 is conveyed to a registration roller 134 by a feed roller 131 and conveyance rollers 132 and 133. After that, the sheet S is sent to a secondary transfer formed by the secondary transfer roller 112 and the secondary transfer counter roller 110, at a predetermined timing by the registration roller 134.

Meanwhile, in the image former 101, first, the charging unit 103Y charges the surface of the photoconductive drum 102Y. After that, according to an image signal transmitted from, for example, an external device not illustrated, the optical scanning unit 104Y irradiates the surface of the photoconductive drum 102Y with laser light, to form an electrostatic latent image on the surface of the photoconductive drum 102Y.

Next, the developing unit 105Y causes yellow toner to adhere to the electrostatic latent image formed on the surface of the photoconductive drum 102Y such that a yellow toner image is formed on the surface of the photoconductive drum 102Y.

The toner image formed on the surface of the photoconductive drum 102Y is primary-transferred to the intermediate transfer belt 107 by application of a bias to the primary transfer unit 111Y.

Due to similar processes, the surfaces of the photoconductive drums 102M, 102C, and 102K are irradiated with laser light by the corresponding optical scanning units 104 according to image signals, resulting in formation of a magenta toner image, a cyan toner image, and a block toner image. Then, due to application of a primary transfer bias to each of the primary transfer units 111M, 111C, and 111K, the corresponding toner image is transferred so as to be superimposed on the yellow toner image on the intermediate transfer belt 107. Thus, a full-color toner image is formed on the surface of the intermediate transfer belt 107.

After that, due to circumferential run of the intermediate transfer belt 107, the full-color toner image is sent to the secondary transfer. Then, due to application of a bias to the secondary transfer roller 112, the full-color toner image on the intermediate transfer belt 107 is transferred to the sheet S at the secondary transfer.

Next, the sheet S having the toner image transferred thereto is subjected to heating and pressing by a fixing unit 113, so that the toner image on the sheet S is fixed to the sheet S. After that, the sheet S having the toner image fixed thereto is discharged to a discharge tray 114 by a discharge roller 135.

<Optical Scanning Unit>

Next, the configuration of an optical scanning unit 104 (optical scanner) will be described.

Figure 2:
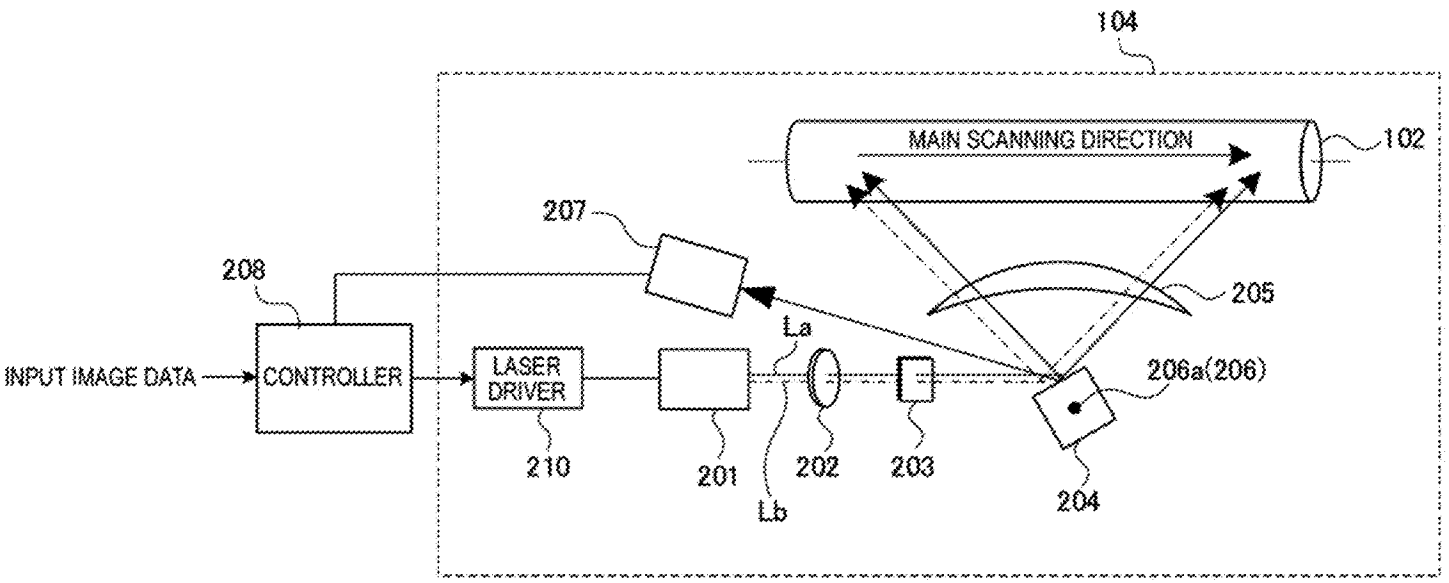
FIG. 2 is a schematic view of an optical scanning unit.

FIG. 2 is a schematic view of an optical scanning unit 104. As illustrated in FIG. 2, the optical scanning unit 104 includes a light source 201 that emits two beams of laser light, and a collimator lens 202 that adjusts laser light to collimated light. The optical scanning unit 104 further includes a cylindrical lens 203 that condenses, in the sub-scanning direction that is the rotational direction of the photoconductive drum 102 (photoconductor), the laser light having passed through the collimator lens 202, a polygon mirror 204 that causes the laser light having passed through the cylindrical lens 203 to scan, an imaging lens 205, and a BD sensor 207. The imaging lens 205 causes the laser light reflected off the polygon mirror 204 to form an image on the surface of the photoconductive drum 102, and corresponds to an inconstant-velocity scanning optical component having no fθ characteristic.

The light source 201 corresponds to a multi-beam laser light source including laser diodes, of which the number of beams is two, arranged, and emits a first beam La and a second beam Lb as two beams of laser light. The light source 201 is installed rotatably around the central axis between the optical axes of emission of the first beam La and the second beam Lb.

The polygon mirror 204 has four reflective faces supported by a motor shaft 206*a* of a motor 206. With the reflective faces rotating about the motor shaft 206*a*, the polygon mirror 204 reflects and deflects the first beam La and the second beam Lb, so that the first beam La and the second beam Lb scan in the main scanning direction (in the rotational-axis direction of the photoconductive drum 102) on the surface of the photoconductive drum 102 that is a face to be scanned. That is, every time the first beam La and the second beam Lb reflected off a reflective face of the polygon mirror 204 scan one time on the photoconductive drum 102, two scan lines are simultaneously formed on the surface of the photoconductive drum 102. The BD sensor 207 detects the first beam La deflected by the polygon mirror 204 and outputs a BD signal as a horizontal synchronizing signal.

Figure 3:
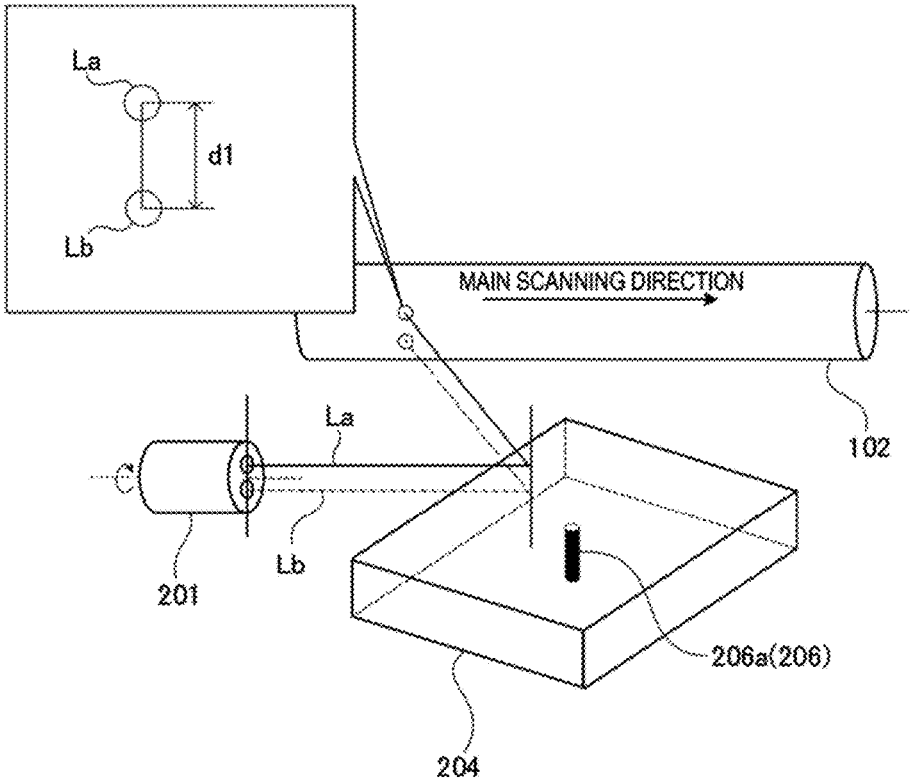
FIG. 3 is a schematic view illustrating the incident positions of a first beam and a second beam to a polygon mirror and the scanning positions of the first beam and the second beam on a photoconductive drum.

FIG. 3 is a schematic view illustrating the incident positions of the first beam La and the second beam Lb emitted from the light source 201 to the polygon mirror 204 and the scanning positions of the first beam La and the second beam Lb on the photoconductive drum 102. The installation illustrated in FIG. 3 is such that the first beam La and the second beam Lb are concurrently incident on a reflective face of the polygon mirror 204 and the motor shaft 206*a*. In this case, when the surface of the photoconductive drum 102 is exposed by one pixel with the first beam La and the second beam Lb, the interval between the first beam La and the second beam Lb in the sub-scanning direction on the photoconductive drum 102 is d1.

Figure 4:
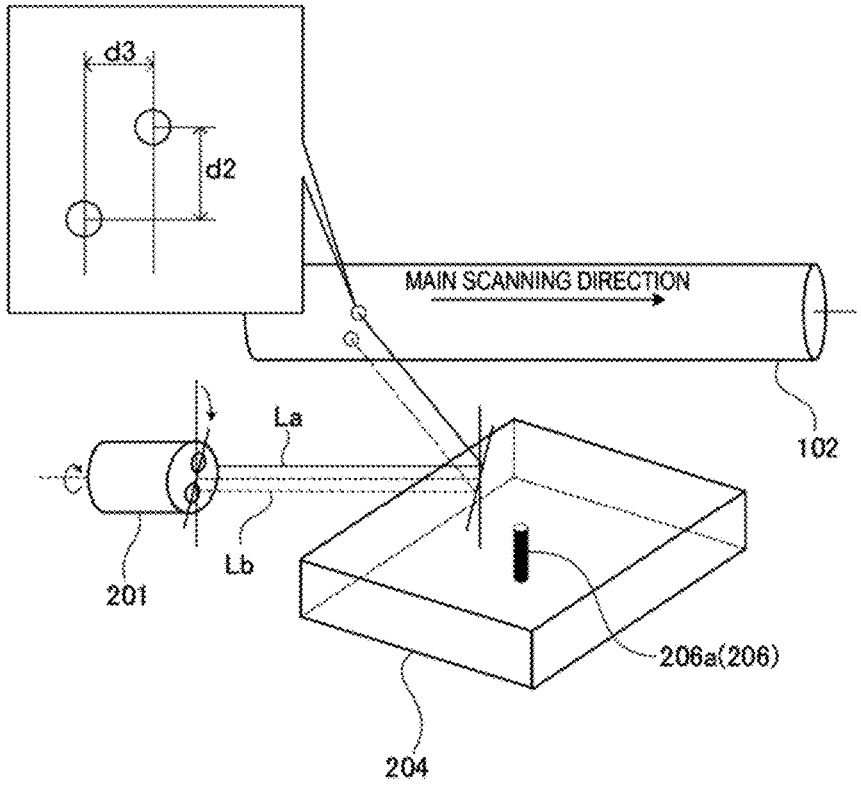
FIG. 4 is a schematic view illustrating the incident positions of the first beam and the second beam to the polygon mirror and the scanning positions of the first beam and the second beam on the photoconductive drum.

FIG. 4 is a schematic view illustrating the incident positions of the first beam La and the second beam Lb emitted from the light source 201 to the polygon mirror 204 and the scanning positions of the first beam La and the second beam Lb on the photoconductive drum 102. In comparison to the configuration illustrated in FIG. 3, FIG. 4 illustrates that each member is disposed with the light source 201 having its rotational angle of installation adjusted such that the interval in the sub-scanning direction on the photoconductive drum 102 is identical to an interval d2 as a predetermined resolution. FIG. 4 illustrates the polygon mirror 204 at a rotational position corresponding to the 0-th pixel in the main scanning direction of the first beam La on the photoconductive drum 102 (writing start position). As illustrated in FIG. 4, in a case where the photoconductive drum 102 is exposed with the first beam La and the second beam Lb, simultaneously, the distance between the positions in the main scanning direction of the first beam La and the second beam Lb is d3. Here, exposure with the second beam Lb is performed with a delay in time corresponding to the distance d3, resulting in writing start position correction for agreement in writing start position between the first beam La and the second beam Lb.

Figure 5:
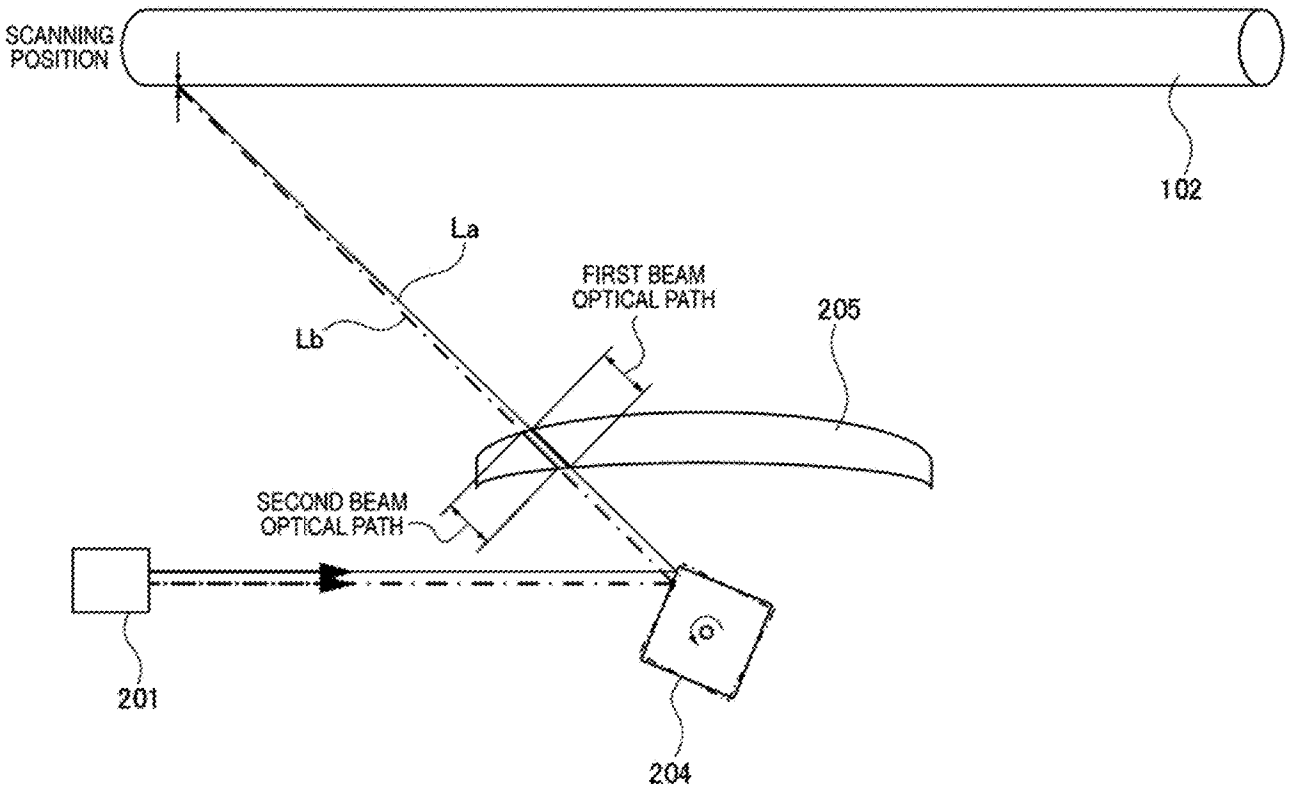
FIG. 5 is a perspective view of the internal configuration of an optical box, in which the optical paths of the first beam and the second beam are illustrated.

FIG. 5 is a schematic view of the optical path of each beam viewed in the rotational-axis direction of the motor shaft 206*a*, with agreement in writing start position due to exposure with the second beam Lb having a delay in time corresponding to the distance d3 illustrated in FIG. 4. In FIG. 5, because the first beam La and the second beam Lb are different in the time of exposure, the polygon mirror 204 has a rotation by a minute angle.

As illustrated in FIG. 5, the first beam La and the second beam Lb are identical in main scanning position on the photoconductive drum 102, but are different in optical path (incident position to a reflective face of the polygon mirror 204, and transmission position in, incident angle to, and emergent angle from the imaging lens 205). Therefore, even in a case where exposure is performed with the first beam La and the second beam Lb identical in exposure time and exposure intensity, due to variations in exposure intensity on the photoconductive drum 102, nonuniformity in light quantity is likely to occur in the beam-number cycle between the first beam La and the second beam Lb.

Thus, in a case where the photoconductive drum 102 is exposed with the first beam La and the second beam Lb identical in main scanning position but with the first beam La and the second beam Lb different in exposure time and in optical-path characteristic, correction is required such that the pixel width is constant. Thus, the optical scanning unit 104 is provided with the controller 208 (refer to FIG. 2) that corrects the exposure time of laser light for a constant pixel width on the photoconductive drum 102 through the inconstant-velocity scanning optical component. The controller 208 not only performs corrections in partial scaling factor characteristic and partial light quantity according to the scanning position on the photoconductive drum 102 but also performs corrections in partial scaling factor characteristic and light-quantity characteristic for each beam, according to the optical-path characteristics of the first beam La and the second beam Lb.

<Image Processing>

Next, image processing by the controller 208 will be described.

Figure 6:
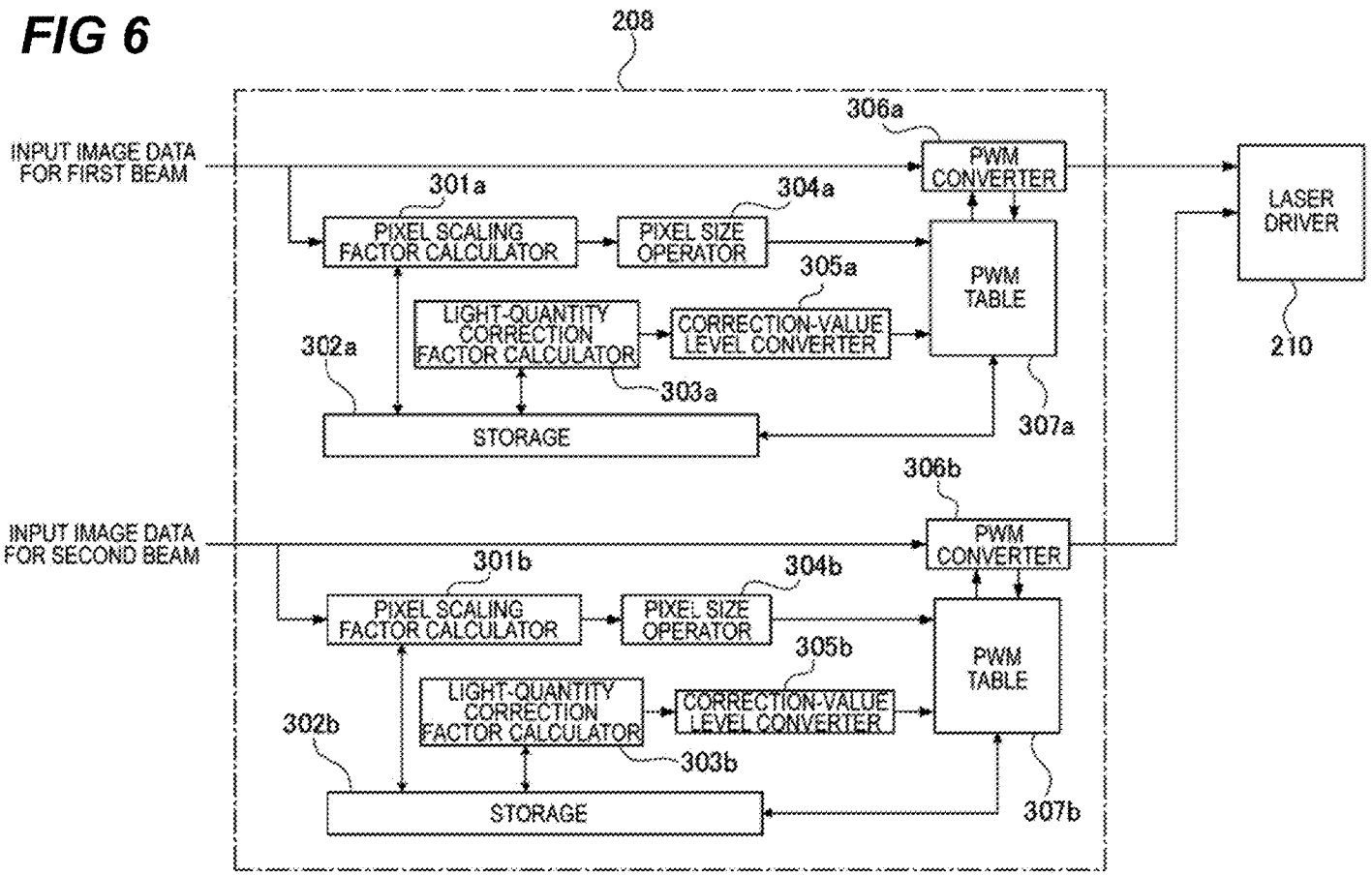
FIG. 6 is a block diagram of a controller.

FIG. 6 is a block diagram of the controller 208. As illustrated in FIG. 6, the controller 208 includes an independent part for image processing for the first beam La and an independent part for image processing for the second beam Lb. Specifically, the controller 208 includes pixel scaling factor calculators 301*a* and 301*b*, storages 302*a* and 302*b*, light-quantity correction factor calculators 303*a* and 303*b*, and pixel size operators 304*a* and 304*b*. The controller 208 further includes correction-value level converters 305*a* and 305*b*, PWM converters 306*a* and 306*b*, and PWM tables 307*a* and 307*b*.

The pixel scaling factor calculators 301*a* and 301*b* each calculate the pixel scaling factor corresponding to the pixel position from a pixel scaling factor profile, to be described below. The storages 302*a* and 302*b* each store the pixel scaling factor profile as a parameter for pixel scaling factor calculation on the photoconductive drum 102, a light-quantity correction factor profile as a parameter for light-quantity correction factor calculation on the photoconductive drum 102, and PWM tables.

The light-quantity correction factor calculators 303*a* and 303*b* each calculate the light-quantity correction value corresponding to the pixel position from the light-quantity correction factor profile. The pixel size operator 304*a* (pixel size calculator) calculates a pixel size from the pixel scaling factor calculated by the pixel scaling factor calculator 301*a*, and the pixel size operator 304*b* (pixel size calculator) calculates a pixel size from the pixel scaling factor calculated by the pixel scaling factor calculator 301*b*.

The correction-value level converter 305*a* (light-quantity value quantization converter) converts the light-quantity correction value calculated by the light-quantity correction factor calculator 303*a* into a correction-value level, and the correction-value level converter 305*b* (light-quantity value quantization converter) converts the light-quantity correction value calculated by the light-quantity correction factor calculator 303*b* into a correction-value level. The PWM converter 306*a* (signal converter) converts input image data into PWM data for laser driving, according to the PWM table 307*a*, to be described below, and the PWM converter 306*b* (signal converter) converts input image data into PWM data for laser driving, according to the PWM table 307*b*, to be described below. The PWM table 307*a* (selector) is read from the storage 302*a* by the pixel size operator 304*a* and the correction-value level converter 305*a*, and the PWM table 307*b* (selector) is read from the storage 302*b* by the pixel size operator 304*b* and the correction-value level converter 305*b*.

The input image data illustrated in FIG. 2 is subjected, through divisions for the first beam La and the second beam Lb, to the processing described above in each part of the controller 208. After that, the input image data is output, as input image data for the first beam La and input image data for the second beam Lb, to a laser driver 210. The laser driver 210 drives the light source 201, according to the input image data for the first beam La and the input image data for the second beam Lb.

Figure 7:
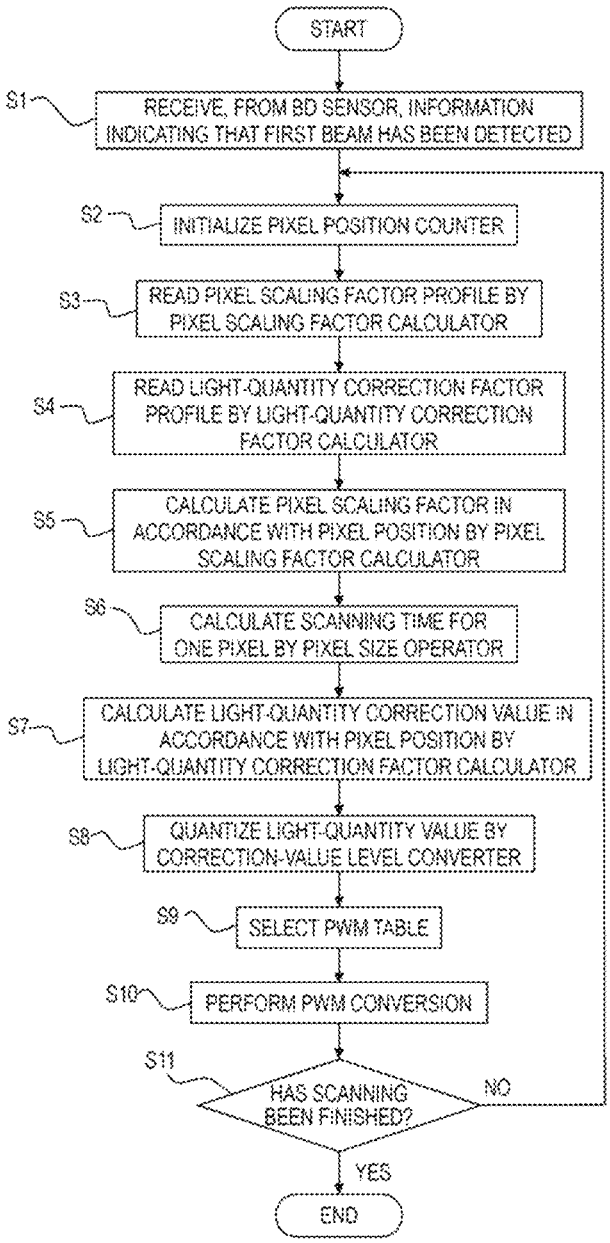
FIG. 7 is a flowchart of the image processing operation of the controller.

FIG. 7 is a flowchart of the image processing operation of the controller 208. The image processing operation regarding the first beam La of the controller 208 will be described below. Note that, similarly, the image processing operation regarding the second beam Lb is performed with a module for the second beam Lb. The image processing operation in the following description is performed with, as one cycle, the operation from the point in time the first beam La as laser light enters the BD sensor 207 until the next scan starts through a scan on the photoconductive drum 102. Note that, similarly, the image processing operation regarding the second beam Lb starts in response to detection of the first beam La by the BD sensor 207.

As illustrated in FIG. 7, when receiving information indicating that the first beam La has been detected, from the BD sensor 207, the controller 208 initializes a pixel position counter not illustrated (S1 and S2). The pixel position counter increments per pixel. The pixel scaling factor calculator 301*a* and the light-quantity correction factor calculator 303*a* obtain the pixel position from the pixel position counter. At the timing of entry of the first beam La as laser light to the BD sensor 207, the pixel scaling factor calculator 301*a* reads the pixel scaling factor profile from the storage 302*a* and the light-quantity correction factor calculator 303*a* reads the light-quantity correction factor profile from the storage 302*a* (S3 and S4).

Next, the pixel scaling factor calculator 301*a* performs pixel scaling factor calculation, according to the pixel position with the pixel scaling factor profile read from the storage 302*a* (S5). The pixel scaling factor profile is stored as the parameter for a mathematical expression for the pixel scaling factor in each region due to division of one scan into three regions.

Figure 8:
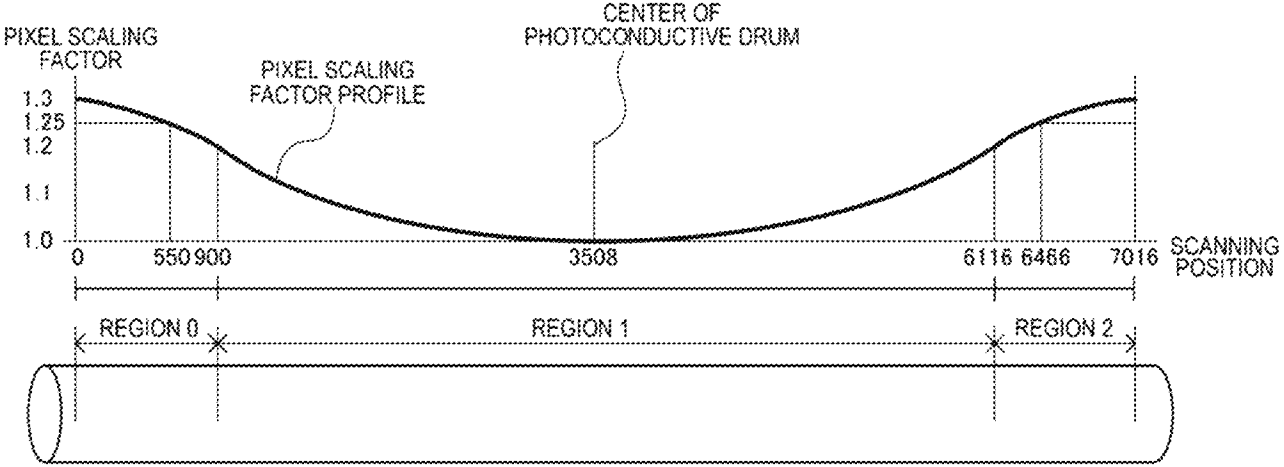
FIG. 8 illustrates the pixel scaling factor to the pixel position of the first beam.

FIG. 8 illustrates the pixel scaling factor to the pixel position of the first beam La. The vertical axis represents the pixel scaling factor, and the horizontal axis represents the pixel position. Regions 0 and 2 correspond to the end portions of the photoconductive drum 102, and can be each provided with a scaling factor curve approximated to a convex quadratic function. Region 1 corresponds to the central portion of the photoconductive drum 102, and can be provided with a scaling factor curve approximated to a concave quadratic function.

As illustrated in FIG. 8, the pixel scaling factor profile is symmetric with respect to the center of the photoconductive drum 102. The pixel scaling factor calculator 301*a* calculates the scaling factor for each pixel with the following approximate expression: $f(x)=a_n \cdot x^2+b_n \cdot x+c_n$, where n represents the region number (0, 1, or 2) and x represents the position on the photoconductive drum 102 (0 to the end in each region). In addition, $a_0$, $a_1$, $a_2$, $b_0$, $b_1$, $b_2$, $c_0$, $c_1$, and $c_2$ are stored as parameters in the storage 302*a*.

Here, the operation of the pixel scaling factor calculator 301*a* for region 0 will be described. The pixel scaling factor calculator 301*a* extracts $a_0$, $b_0$, and $c_0$ from the storage 302*a* and calculates, for each pixel, the following: $f(x)=a_0 \cdot x^2+b_0 \cdot x+c_0$. For simplification of calculation, calculation is performed with a difference method, obtaining the followings:

$$f(x) = c_0 \qquad (x = 0)$$

$$f(x) = f(x-1) + f(x-1)' \quad (x \neq 0)$$

The differential value of the second term on the right side satisfies the following: $f(x-1)'=2 \cdot a_0+b_0$. This is calculated with the difference method.

Note that, when the following is satisfied: x=0, a reduction is made in error by central differencing. With the central value based on $f(0)'=b_0$ (x=0) and $f(1)'=2 \cdot a_0+b_0$ (x=1), the followings are obtained:

$$f_{(x)}' = \frac{1}{2} \cdot \{(b_0) + (2 \cdot a_0 + b_0)\} = a_0 + b_0 \quad (x = 0)$$

$$f_{(x)}' = f_{(x-1)}' + f_{(x-1)}'' \qquad (x \neq 0)$$

The differential value of the second term on the right side satisfies the following: $f(x)''=2 \cdot a_0$.

The mathematical expressions described above lead to the followings:

$$f_{(0)} = c_0,\ f_{(0)}' = a_0 + b_0 \tag{1}$$

$$f_{(x)} = f_{(x-1)} + f_{(x-1)}' \quad (x \neq 0) \tag{2}$$

$$f_{(x)}' = f_{(x-1)}' + f_{(x-1)}'' \quad (x \neq 0) \tag{3}$$

where the followings are given as real values: $a_0=-5.7720\times10^{-8}$, $b_0=-5.9163\times10^{-5}$, and $c_0=1.3000$.

The pixel scaling factor for the first pixel is as follows: $f(0)=c_0=1.3$. Here, Expression (1) above leads to the following: $f(0)'=a_0+b_0=-5.9221\times10^{-5}$.

Based on Expression (2) above and the calculated value for the first pixel, the pixel scaling factor for the second pixel is as follows: $f(1)=f(0)+f(0)'=c_0+a_0+b_0=1.2999$. Simultaneously, Expression (3) above leads to $f(1)'=f(0)'+f(0)''=(a_0+b_0)+(2 \cdot a_0)=3 \cdot a_0+b_0=-5.9336\times10^{-5}$.

Based on Expression (2) above and the calculated value for the second pixel, the pixel scaling factor for the third pixel is as follows: $f(2)=f(1)+f(1)'=(c_0+a_0+b_0)+(3 \cdot a_0+b_0)=4 \cdot a_0+2 \cdot b_0+c_0=1.2999$. Simultaneously, the following is obtained: $f(2)'=f(1)'+f(1)''=(3 \cdot a_0+b_0)+(2 \cdot a_0)=5 \cdot a_0+b_0=-5.9452\times10^{-5}$.

Similarly, from the fourth pixel to the 7016-th pixel at 600 dpi or to the 14032-th pixel at 1200 dpi in the main scanning, the followings are sequentially calculated: $f(x+1)=f(x)+f(x)'$ and $f(x+1)'=f(x)'+f(x)''$. FIG. 9(*a*) indicates results of calculation at 600 dpi.

The calculation described above involves x=0 to 9 indicated in FIG. 9(*a*). The results of calculation at x=2075 to 2084 correspond to a range of region 1 away almost by a quarter of the photoconductive drum 102 from the left end of the photoconductive drum 102, and the results of calculation at x=4931 to 4940 correspond to a range of region 1 away almost by a quarter of the photoconductive drum 102 from the right end of the photoconductive drum 102. The results of calculation herein result from the calculation described above with $a_1=2.9405\times10^{-8}$, $b_1=-1.5337\times10^{-4}$, and $c_1=1.2000$ as parameters. Similarly, the results of calculation at x=7007 to 7016 correspond to a range of region 2 near the rear end of the photoconductive drum 102, and thus $a_2=-5.7720\times10^{-8}$, $b_2=1.6306\times10^{-4}$, and $c_2=1.2000$ are used as parameters. As above, the pixel scaling factor calculator 301*a* performs scaling factor calculation per pixel.

Next, the pixel size operator 304*a* in the controller 208 obtains the scanning time for one pixel (=the pixel size of one pixel) from the pixel scaling factor obtained by the pixel scaling factor calculator 301*a* (S6). Because the image density in the section of one pixel is output with a PWM signal, the laser driver 210 needs to make a cycle of PWM correspond to the scanning time for one pixel. For example, with one laser, 50 PPM, 600 dpi, and a PWM generator having a resolution of 3.84 GHz and with the BD signal having a cycle of approximately 231 μs and an image effective range of 70%, the ideal cycle for one pixel is as follows:

$$\frac{(231\ \mu s\times 70\%)}{\frac{310\ mm}{25.4\ mm}\times 600\ DPI}=\frac{161.7\ \mu s}{7322.8\ dots}=22.2\ ns/dot$$

The following is obtained due to division by the resolution power of the PWM generator.

$$\frac{22.2\ ns/dot}{\frac{1}{3.84\ GHz}}=22.2\times10^{-9}\times3.84\times10^{9}=85.25\ count$$

Due to a counter, not illustrated, that operates at 3.84 GHz, PWM having a cycle of 85.25 counts corresponds to the ideal value. Here, 85.25 counts are set in advance as a pixel scaling factor of 1. The pixel size is obtained by multiplying the pixel scaling factor calculated in step S5 by 85.25. As described below, because the pixel size value is to be used as the count value of the counter in the PWM generator, the fractional portion thereof cannot be shown. Therefore, the fractional portion is rounded off for output of an integer. The discarded error is taken in as the initial value for the next pixel cycle.

For example, for the first pixel, the following is obtained: 85.25×f(0)=110.8250. Thus, the pixel size is 111, and the error is −0.1750. For the second pixel, the following is obtained: 85.25×f(1)+(−0.1750)=110.6450. Thus, the pixel size is 111, and the error is −0.3550. For the third pixel, the following is obtained: 85.25×f(2)+(−0.3704)=110.4598. Thus, the pixel size is 110, and the error is 0.4598.

For the fourth pixel and the subsequent pixels, similar calculations are made. The results of calculation are indicated in FIG. 9(*b*). The calculation described above involves x=0 to 9 indicated in FIG. 9(*b*). The results of calculation at x=2075 to 2084 correspond to a region away almost by a quarter of the photoconductive drum 102 from the leading end of the photoconductive drum 102 and the results of calculation at x=4931 to 4940 correspond to a region away almost by a quarter of the photoconductive drum 102 from the rear end of the photoconductive drum 102, in which the regions are identical in scaling factor. The pixel size near the center of the photoconductive drum 102 omitted is minimum and is as follows: 111÷1.3≈85. Similarly, the results of calculation at x=7007 to 7016 correspond to a region near the rear end of the photoconductive drum 102 and are symmetric to those in region 0. In this manner, the pixel size operator 304*a* performs size calculation per pixel.

Figure 10:
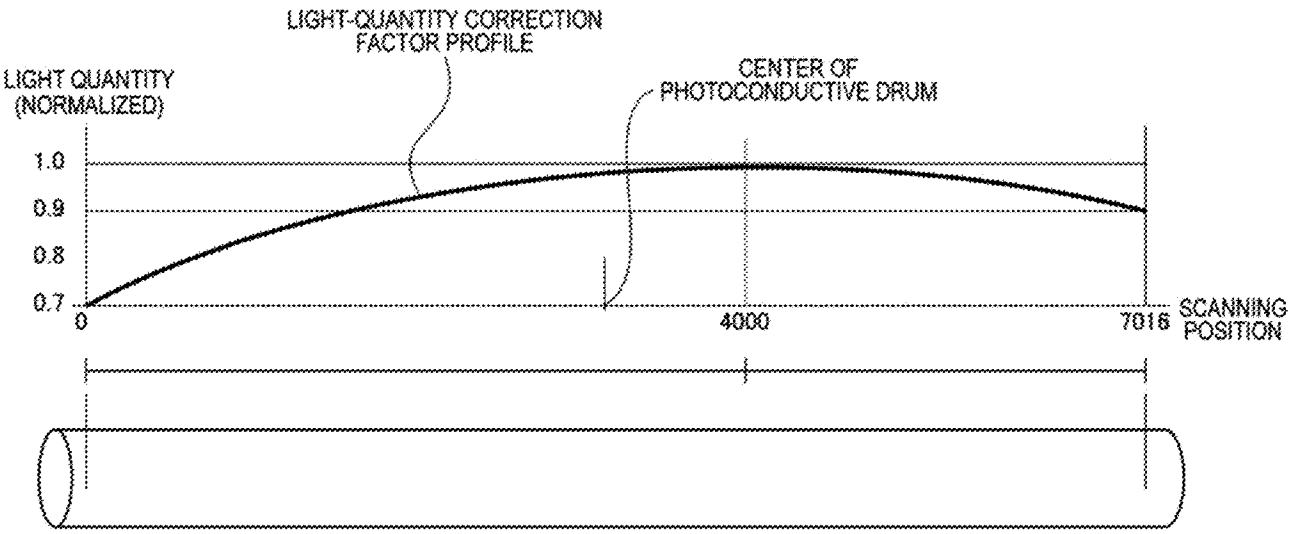
FIG. 10 is a graph of a light-quantity correction factor profile as a function of pixel position.

Next, the light-quantity correction factor calculator 303*a* in the controller 208 calculates the light-quantity correction value corresponding to the pixel position, with the light-quantity correction factor profile read from the storage 302*a* (S7). FIG. 10 is a graph of the light-quantity correction factor profile as a function of pixel position. The light-quantity correction factor profile illustrated in FIG. 10 has been approximated with a convex quadratic curve $g(x)=\alpha\cdot x^2+\beta\cdot x+\gamma$. Note that the position of the extreme point is not identical to the center of the photoconductive drum 102. The parameters α, β, and γ are each stored for the light-quantity profile in the storage 302*a*. In the present embodiment, the followings are provided: $\alpha=-1.5416\times10^{-8}$, $\beta=1.3666\times10^{-4}$, and $\gamma=7.0000$.

The light-quantity correction factor calculator 303*a* extracts α, β, and γ from the storage 302*a* and calculates, for each pixel, the following: $g(x)=\alpha\cdot x^2+\beta\cdot x+\gamma$. The light-quantity correction factor calculator 303*a* calculates the light-quantity correction factor by calculating the above with a difference method. Here, the light-quantity correction factor indicates the ratio to a light quantity of 1 per one pixel at the time of a scan at the central position of the photoconductive drum 102.

The light-quantity correction factor for the first pixel is as follows: $g(0)=\gamma=0.7$. The following is obtained: $g(0)'=\alpha+\beta=1.3665\times10^{-4}$. The light-quantity correction factor for the second pixel is as follows: $g(1)=g(0)+g(0)'=\gamma+\alpha+\beta=7.0014\times10^{-1}$. The following is obtained: $g(1)'=g(0)'+g(0)''=(\alpha+\beta)+(2\cdot\alpha)=3\cdot\alpha+\beta=1.3662\times10^{-4}$. The light-quantity correction factor for the third pixel is as follows: $g(2)=g(1)+g(1)'=(\gamma+\alpha+\beta)+(3\cdot\alpha+\beta)=4\cdot\alpha+2\cdot\beta+\gamma=7.0027\times10^{-1}$. The following is obtained: $g(2)'=g(1)'+g(1)''=(3\cdot\alpha+\beta)+(2\cdot\alpha)=5\cdot\alpha+\beta=1.3659\times10^{-4}$. For from the fourth pixel to the last pixel in the region, similarly, the light-quantity correction factor is sequentially calculated with the following: $g(x+1)=g(x)+g(x)'$. In addition, the following is calculated: $g(x+1)'=g(x)'+g(x)''$.

FIG. 9(*c*) indicates the results of calculation of the light-quantity correction factor for the fourth pixel and the subsequent pixels. The light-quantity correction factor at x=0 to 9 corresponding to the leading end portion of the photoconductive drum 102 is approximately 0.7 due to a drop in light quantity resulting from high scanning velocity. The light-quantity correction factor at x=2075 to 2084 corresponding to a region away almost by a quarter of the photoconductive drum 102 from the left end of the photoconductive drum 102 and the light-quantity correction factor at x=4931 to 4940 corresponding to a region away almost by a quarter of the photoconductive drum 102 from the right end of the photoconductive drum 102 are, respectively, 0.917 and 0.999 different clearly. The light-quantity correction factor at x=7007 to 7016 corresponding to the rear end portion of the photoconductive drum 102 indicates approximately 0.9 due to a drop in light quantity resulting from high scanning velocity similar to that in the leading end portion. In this manner, the light-quantity correction factor calculator 303*a* calculates the light-quantity correction factor per pixel.

Next, the correction-value level converter 305*a* in the controller 208 restricts the light-quantity correction value obtained in step S7 from 0.7 to 1 and sorts the range of from 0.7 to 1 into 8 levels (S8). FIG. 11 is a table for 8-level sorting in light-quantity correction amount. The light-quantity correction value that is larger than the minimum value and is not more than the maximum value at each level is converted into the corresponding light-quantity level.

FIG. 9(*d*) indicates results of conversion from the light-quantity correction factor to the light-quantity level. The light-quantity level at x=0 to 9 corresponding to a region near the left end of the photoconductive drum 102 is 0. The light-quantity level at x=2075 to 2084 corresponding to a region away almost by a quarter of the photoconductive drum 102 from the left end of the photoconductive drum 102 is 5 or 6. The light-quantity level at x=4931 to 4940 corresponding to a region away almost by a quarter of the photoconductive drum 102 from the right end of the photoconductive drum 102 is 7. The light-quantity level at x=7007 to 7016 corresponding to a region near the rear end of the photoconductive drum 102 is 5 or 6. In this manner, the correction-value level converter 305*a* performs light-quantity level conversion per pixel.

Next, the PWM table 307*a* in the controller 208 selects a PWM table to be read from the storage 302*a*, based on the pixel size value and the light-quantity level value (S9). Data of PWM tables is set in advance in the storage 302*a*.

Figure 12:
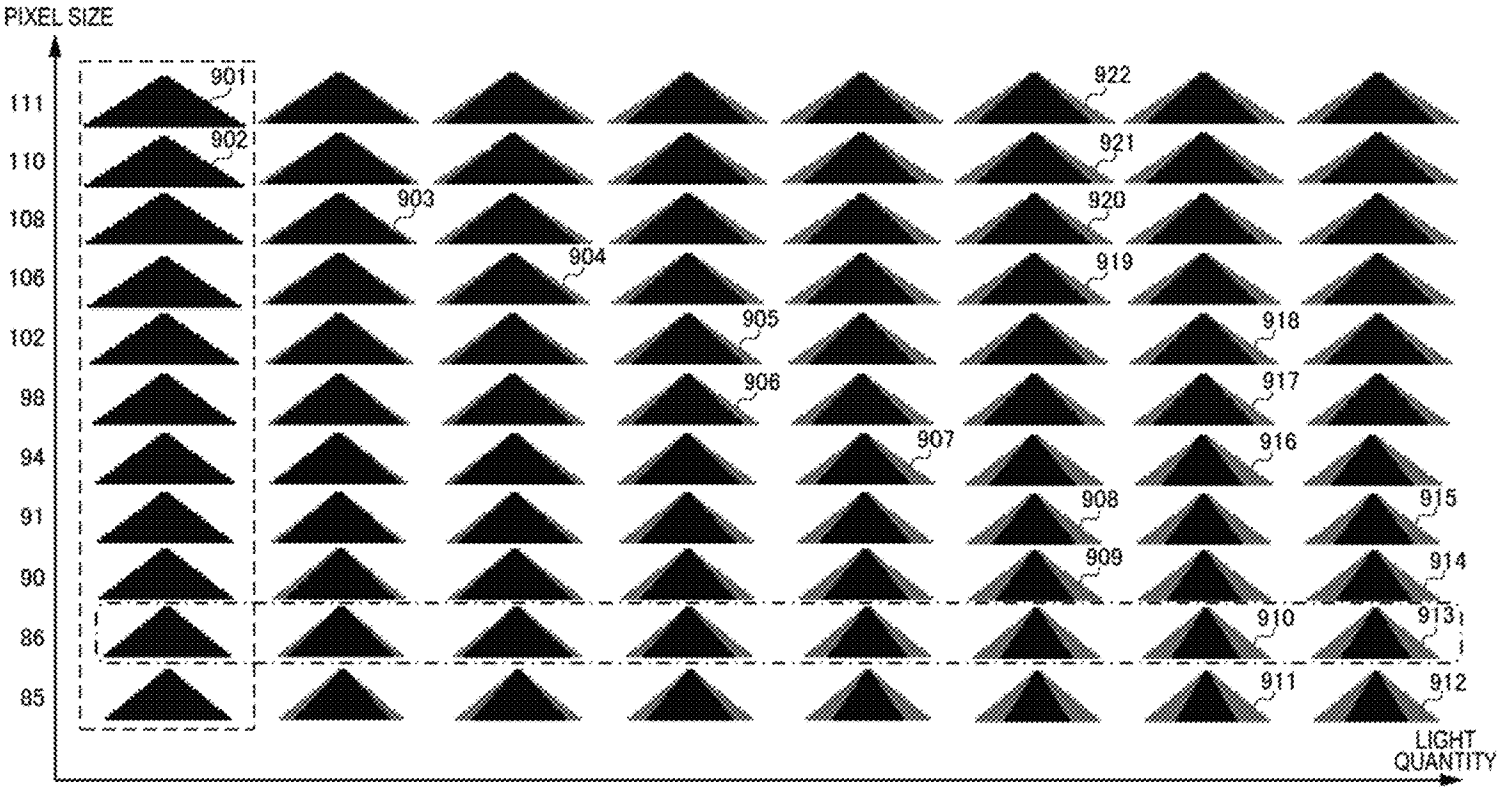
FIG. 12 illustrates PWM tables.

FIG. 12 illustrates PWM tables according to the present embodiment. In FIG. 12, for simplification in description, PWM tables different in pixel size are arranged in the vertical direction and PWM tables different in light-quantity level are arranged in the horizontal direction. For example, the PWM table 307*a* selects the table 901 in a case where the pixel size is 111 and the light-quantity level is 0. For example, only for scaling factor correction without light-quantity correction, with the pixel size ranging from 85 to 111 at a light-quantity level of 0 inside a dashed line indicated in FIG. 12, a selection can be made in PWM every one pixel according to the pixel size. Although the pixel size is discontinuous in value in the vertical axis in FIG. 12, in practice, the pixel size increments in value by 1 from 85 to 111. For example, only for light-quantity correction, with the light-quantity level ranging from 0 to 7 at a pixel size of 86 inside a dot-and-dash line indicated in FIG. 12, a switch is made in PWM according to the light quantity. For comparison, the PWM tables at each pixel size with the light-quantity level ranging from 1 to 7 are each displayed with the PWM table at a light-quantity level of 0 displayed lightly as the background. The PWM table 307*a* selects one from the PWM tables illustrated in FIG. 12, based on the pixel size value output from the pixel size operator 304*a* and the light-quantity level value output from the correction-value level converter 305*a*, to extract the one from the storage 302*a*.

For example, from the results of calculation indicated in FIG. 9, because the pixel size is 111 and the light-quantity level is 0 for the first pixel, the PWM table 307*a* selects the table 901. Because the pixel size is 111 and the light-quantity level is 0 for the second pixel, the table 901 is selected. Because the pixel size is 110 and the light-quantity level is 0 for the third pixel, the table 902 is selected. Because the pixel size is 108 and the light-quantity level is 1 for the 360-th pixel, the table 903 is selected. Because the pixel size is 106 and the light-quantity level is 2 for the 626-th pixel, the table 904 is selected. Because the pixel size is 102 and the light-quantity level is 3 for the 879-th pixel, the table 905 is selected. Because the pixel size is 98 and the light-quantity level is 3 for the 1270-th pixel, the table 906 is selected. Because the pixel size is 94 and the light-quantity level is 4 for the 1620-th pixel, the table 907 is selected.

The PWM table 307*a* selects the table 908 because the pixel size is 91 and the light-quantity level is 5 for the 2075-th pixel corresponding to a region away almost by a quarter of the photoconductive drum 102 from the left end of the photoconductive drum 102. Because the pixel size is 90 and the light-quantity level is 5 for the 2264-th pixel, the table 909 is selected. Because the pixel size is 86 and the light-quantity level is 6 for the 2982-th pixel, the table 910 is selected. Because the pixel size is 85 and the light-quantity level is 6 for the 3095-th pixel, the table 911 is selected. Because the pixel size is 85 and the light-quantity level is 7 for the 3129-th pixel, the table 912 is selected. Because the pixel size is 86 and the light-quantity level is 7 for the 4299-th pixel, the table 913 is selected. Because the pixel size is 90 and the light-quantity level is 7 for the 4865-th pixel, the table 914 is selected.

The PWM table 307*a* selects the table 915 because the pixel size is 91 and the light-quantity level is 7 for the 4932-th pixel corresponding to a region away almost by a quarter of the photoconductive drum 102 from the right end of the photoconductive drum 102. Because the pixel size is 94 and the light-quantity level is 6 for the 5338-th pixel, the table 916 is selected. Because the pixel size is 98 and the light-quantity level is 6 for the 5827-th pixel, the table 917 is selected. Because the pixel size is 102 and the light-quantity level is 6 for the 6143-th pixel, the table 918 is selected. Because the pixel size is 106 and the light-quantity level is 5 for the 6468-th pixel, the table 919 is selected. Because the pixel size is 108 and the light-quantity level is 5 for the 6561-th pixel, the table 920 is selected. Because the pixel size is 110 and the light-quantity level is 5 for the 6850-th pixel, the table 921 is selected. Finally, the PWM table 307*a* selects the table 922 because the pixel size is 111 and the light-quantity level is 5 for the 7016-th pixel corresponding to the right end of the photoconductive drum 102.

In this manner, appropriate switching between PWM tables based on the pixel size and the light-quantity level enables scaling factor correction and light-quantity correction to be performed simultaneously and independently. The selection of a PWM table described above is just exemplary, and thus, in practice, depends on, for example, the conditions of temperature and humidity, a type of sheet S, or the printing scaling factor or density for image data set by a user. For example, the image forming apparatus A in adjustment mode forms a patch pattern on the intermediate transfer belt 107, performs measurements in inter-patch distance, density, and color with a patch sensor, not illustrated, and performs feedback to the pixel scaling factor profile or light-quantity correction profile. As a result, the feedback changes a table to be used from the PWM tables illustrated in FIG. 12. Thus, all the tables are retained and a table is selected as necessary.

Next, the PWM converter 306*a* in the controller 208 converts, for example, 4-bit input image data (density data ranging from 0 to 15) into PWM data, with the PWM table selected by the PWM table 307*a* (S10). The PWM data obtained through the conversion is output as a laser driving signal to the laser driver 210.

Figure 13:
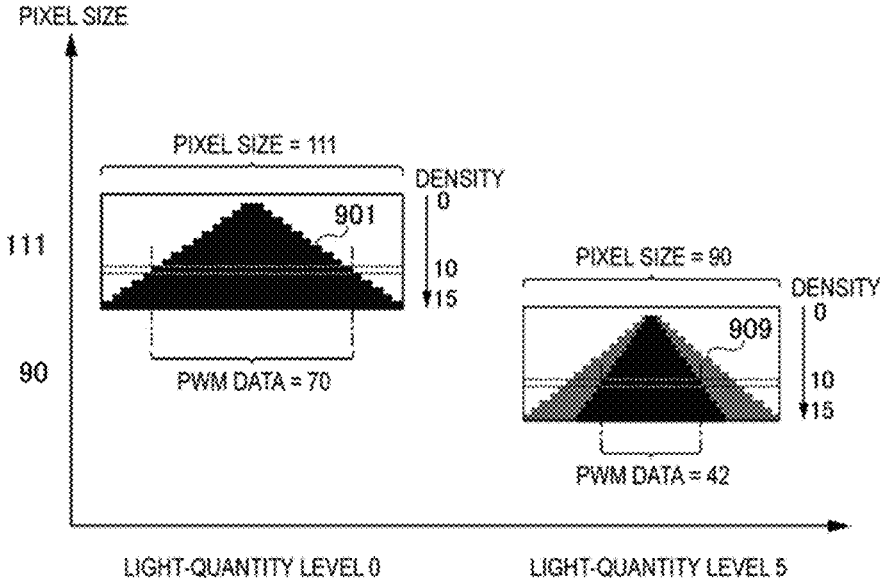
FIG. 13 is a schematic view of conversions with predetermined tables from among the PWM tables.

FIG. 13 is a schematic view of respective conversions with the table 901 and the table 909 from among the PWM tables illustrated in FIG. 12. For example, when input image data having a density of 10 in value is input, the input image data is converted with the table 901 into PWM data (pulse width=70) or is converted with the table 909 into PWM data (pulse width=42).

The controller 208 repeats, for an amount of one time of main scanning of image data, steps S2 to S10 described above every one pixel (S11). Then, in response to completion to an amount of one time of main scanning of image data, the operation to an amount of one time of main scanning terminates.

The operation described above is performed to each scanning line in one page, so that pixel scaling factor correction and light-quantity correction can be performed independently according to the partial scaling factor correction profile and light-quantity correction profile set to each of the first beam La and the second beam Lb. Therefore, corrections can be made in light-quantity characteristic according to the optical paths of the first beam La and the second beam Lb, so that an image having less nonuniformity in light quantity can be output with inhibition of nonuniformity in light quantity from occurring in beam cycle.

<Parameter Measurement Method>

Next, a method of creating profiles to be stored in each of the storages 302*a* and 302*b* will be described. An example with the first beam La will be given below, but the same is done for the second beam Lb with a module for the second beam Lb. Note that, even at the time of measurement of the second beam Lb, the BD sensor 207 detects the first beam La.

Figure 14:
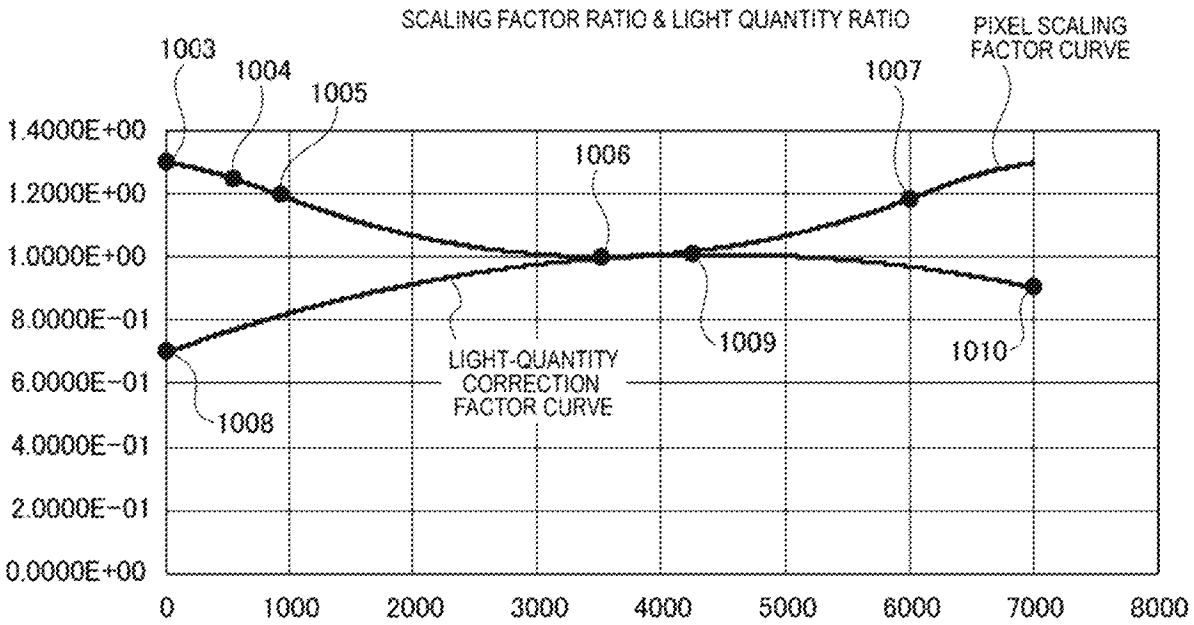
FIG. 14 is a graph of the pixel scaling factor and light-quantity correction factor of the first beam.

FIG. 14 is a graph of the pixel scaling factor and light-quantity correction factor of the first beam La measured every one pixel in the main scanning direction. The graph illustrated in FIG. 14 is obtained from the average value resulting from a plurality of measurements with only the first beam La on with the value of input image data maximum during the time corresponding to one pixel at 600 dpi at the center of the photoconductive drum 102, at each pixel position in the main scanning direction. For example, as the scaling factor and light quantity, respectively, measured are the thickness and density of a vertical line image acquired due to printing with the first beam La on with the value of input image data maximum for 85.25 counts at 3.84 GHz every 50 pixels with the BD cycle as the base, namely, for 22.2 ns. The scaling factor and light quantity measured a plurality of times are normalized with the value at the center of the photoconductive drum 102, resulting in acquisition of the graph. Due to the measurement points every 50 pixels, points having not been practically measured in the graph are interpolated.

As illustrated in FIG. 14, the pixel scaling factor curve is normalized with, as 1, the scaling factor of one pixel exposure to the center of the photoconductive drum 102 with the first beam La, and indicates approximately 1.3 at each end portion of the photoconductive drum 102. The first beam La has a profile symmetric with respect to the center of the photoconductive drum 102. The curve is slightly convex at each end portion of the photoconductive drum 102.

For individual preparations, the pixel scaling factor profile is divided into region 0 corresponding to the left end portion of the photoconductive drum 102, region 1 corresponding to the central portion of the photoconductive drum 102, and region 2 corresponding to the right end portion of the photoconductive drum 102. The pixel scaling factor profile for each region is approximated to a quadratic curve $f(x)=a_0 \cdot x^2+b_0 \cdot x+c_0$, and the coefficients of the quadratic curve are obtained. Substitution of three measurement points enables the calculation. For example, for region 0, with three points of the 0-th pixel that is 1.3 in scaling factor (point 1003), the 550-th pixel that is 1.25 in scaling factor (point 1004), and the 900-th pixel that is 1.2 in scaling factor (point 1005), calculation is performed as below.

$$f_{(0)} = c_0 = 1.3$$

$$f_{(550)} = a_0 \cdot 550^2 + b_0 \cdot 550 + 1.3 = 1.25 \quad ①$$

$$f_{(900)} = a_0 \cdot 900^2 + b_0 \cdot 900 + 1.3 = 1.2 \quad ②$$

The solutions are as follows: $a_0=-5.7720\times10^{-8}$, $b_0=-5.9163\times10^{-5}$, and $c_0=1.3000$.

For region 1, with three points of the 900-th pixel that is 1.2 in scaling factor (point 1005), the 3508-th pixel that is 1.0 in scaling factor (point 1006), and the 6116-th pixel that is 1.2 in scaling factor (point 1007), calculation is performed as below. Note that, for simplification, calculation is performed with, as 0, the beginning pixel for region 1.

$$f_{(900-900)} = c_0 = 1.2$$

$$f_{(3508-900)} = a_0 \cdot 2608^2 + b_0 \cdot 2608 + 1.2 = 1.0 \quad ①$$

$$f_{(6116-900)} = a_0 \cdot 5216^2 + b_0 \cdot 5216 + 1.2 = 1.2 \quad ②$$

The solutions are as follows: $a_1=2.9405\times10^{-8}$, $b_1=-1.5337\times10^{-4}$, and $c_1=1.2000$. Due to similar calculation for region 2, the followings are obtained: $a_2=-5.7720\times10^{-8}$, $b_2=1.6306\times10^{-4}$, and $c_2=1.2000$.

As illustrated in FIG. 14, the light-quantity correction factor curve is a convex quadratic curve and has the maximum value at a position deviating slightly right from the center of the photoconductive drum 102, resulting in being symmetric. Then, the light-quantity correction factor curve is normalized with the maximum value as 1. The minimum value is 0.7 in light quantity at the left end portion of the photoconductive drum 102. The light-quantity correction profile is approximated to one quadratic curve $g(x)=\alpha \cdot x^2+\beta \cdot x+\gamma$, and the coefficients of the quadratic curve are calculated with measurement data of three points, similarly to the above.

With three points of the 0-th pixel that is 0.7 in light-quantity correction factor (point 1008), the 4000-th pixel that is 1.0 in light-quantity correction factor (point 1009), and the 7016-th pixel that is 0.9 in light-quantity correction factor (point 1010), calculation is performed for α, β, and γ. The solutions are as follows: $\alpha=-1.5416\times10^{-8}$, $\beta=1.3666\times10^{-4}$, $\gamma=7.0000$.

The parameters are set in the storage 302*a*, and then the pixel scaling factor profile and light-quantity correction profile for the first beam La are calculated. Similarly, such parameters are set in the storage 302*b*, and then the pixel scaling factor profile and light-quantity correction profile for the second beam Lb are calculated.

Second Embodiment

Next, the configuration of an image forming apparatus according to a second embodiment of the present invention will be described. Parts the same as those in the first embodiment are denoted with the same reference signs and are given with the same drawings, and thus the descriptions thereof will be omitted.

The image forming apparatus A according to the present embodiment is different in configuration from that according to the first embodiment in terms of sharing between a PWM table 307*a* for a first beam La and a PWM table 307*b* for a second beam Lb without any regions corresponding to the pixel size and the light-quantity level not in use. A memory for PWM tables is often included in an SRAM inside an ASIC. However, for a low-cost product, such an SRAM is shared without retention of values not in use, enabling a reduction in cost. Note that, because storages 302*a* and 302*b* for the first beam La and the second beam Lb need to operate simultaneously and independently while sharing a storage area in an SRAM, the SRAM has two ports.

Figure 15:
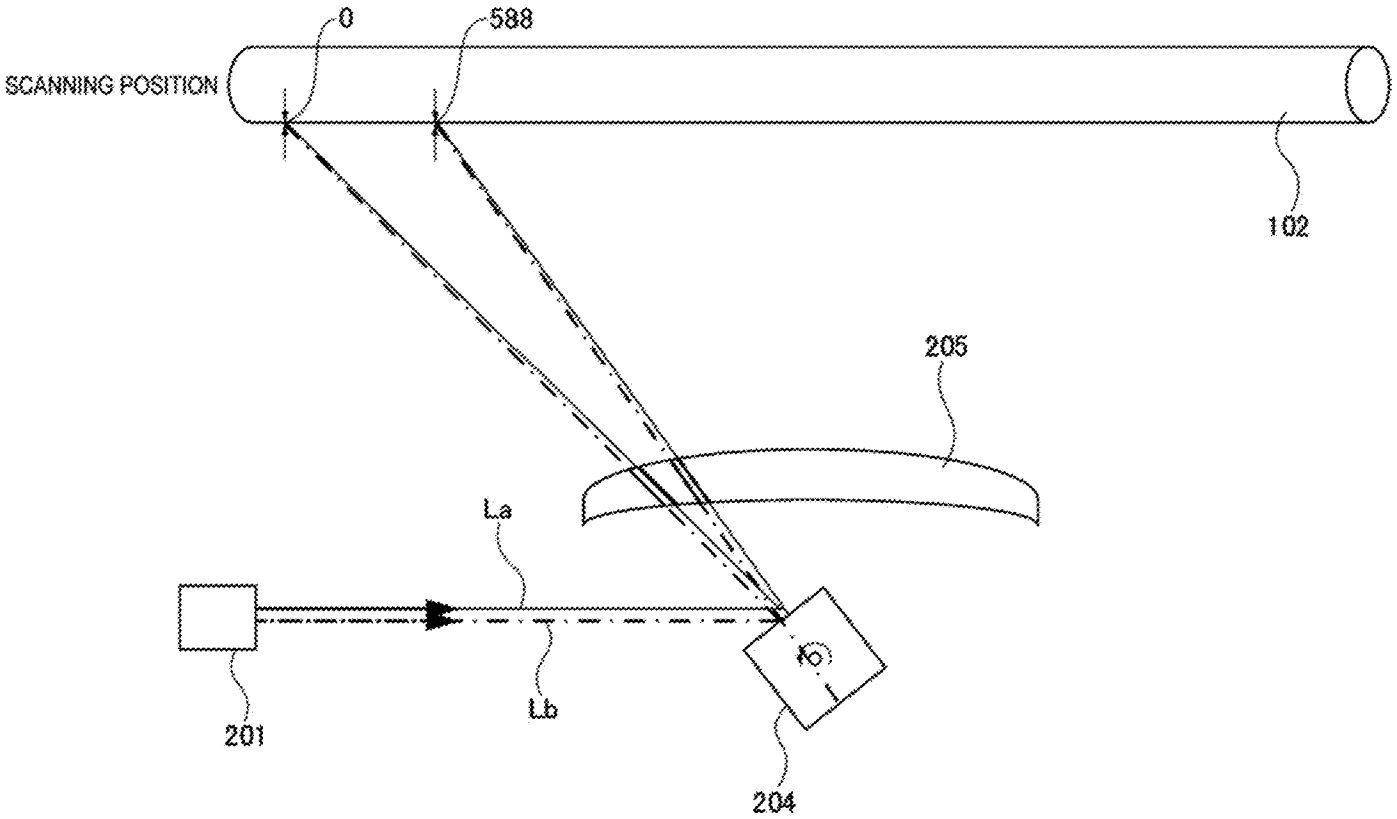
FIG. 15 illustrates the optical paths of the first beam and the second beam.

FIG. 15 illustrates the optical paths of the first beam La and the second beam Lb corresponding to each main scanning position. As illustrated in FIG. 15, although the first beam La and the second beam Lb are different in optical path, the difference in optical path is not so large, namely, only a difference of approximately ±1 is present in light-quantity level. Therefore, if prepared are tables between which a difference of ±1 is present in light quantity in the same pixel size, even when the first beam La and the second beam Lb are different in light-quantity characteristic, the tables are sufficient for use.

For example, for the first beam La, the first pixel is 111 in pixel size and 0 in light-quantity level, and thus the table 901 is selected. At this time, for the second beam Lb at the same main scanning position, the first pixel is 111 in pixel size and 0 in light-quantity level the same as those for the first beam La, and thus the table 901 is selected.

Here, a region near the 588-th pixel at which the first beam La varies in light-quantity level is focused on. For the first beam La, the 588-th pixel is 106 in pixel size and 2 in light-quantity level, and thus the table 905 is selected. Meanwhile, for the second beam Lb, the 588-th pixel is 107 in pixel size and 1 in light-quantity level, and thus the table 905_2 is selected. That is, instead of all two-dimensional combinations of the pixel size (Y-axis direction) and the light-quantity level (X-axis direction) as illustrated in FIG. 12, the minimum necessary tables covering parts to be used for each of the first beam La and the second beam Lb as illustrated in FIG. 16, require preparing.

Figure 16:
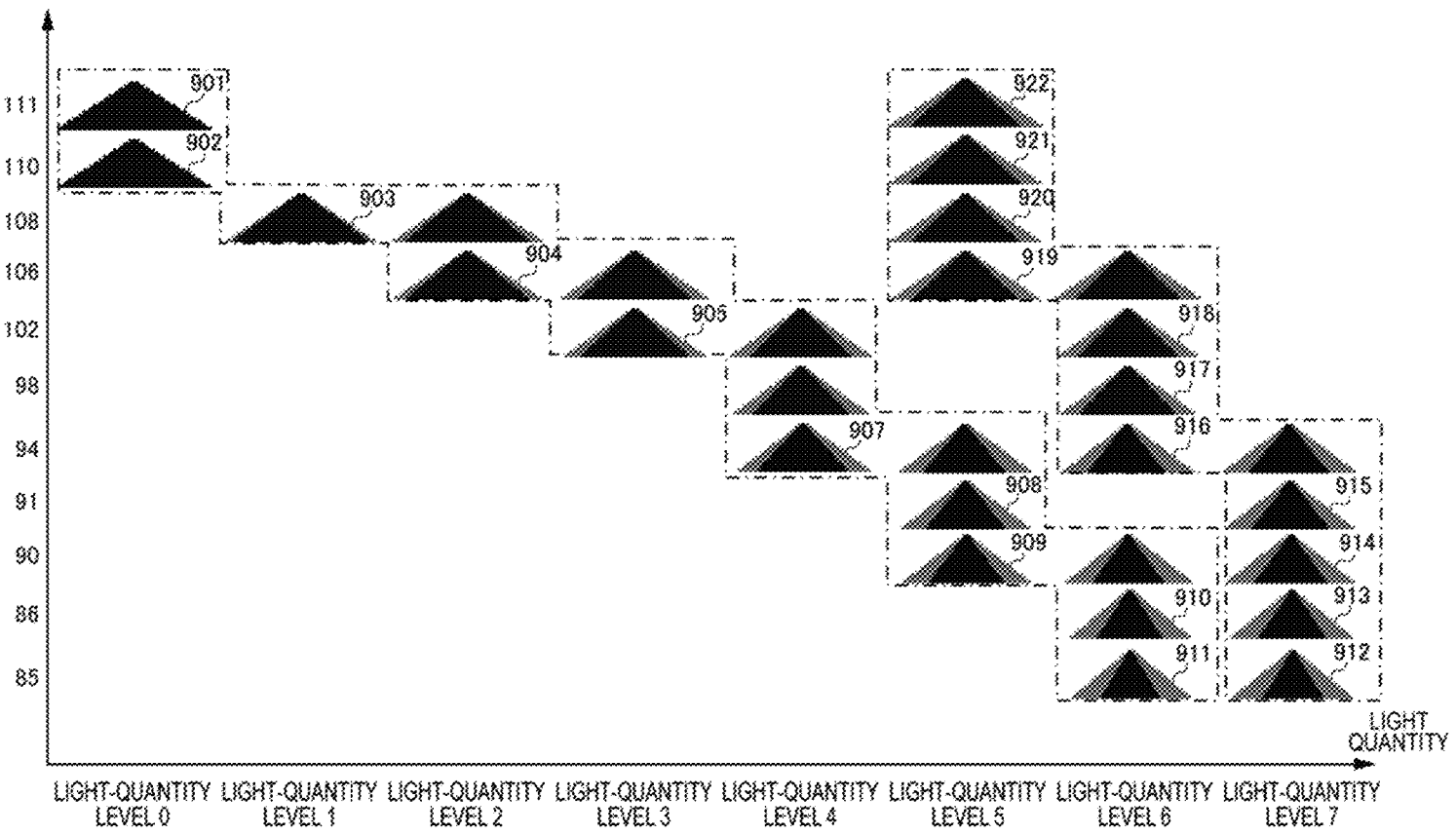
FIG. 16 illustrates part of the PWM tables.

FIG. 16 illustrates part taken from the PWM tables illustrated in FIG. 12. From the pixel scaling factor and the light-quantity correction factor calculated and measured in a process of production, a representative profile for each of the first beam La and the second beam Lb and its parameters are generated. A PWM table to be selected due to calculation based on the main scanning position with the representative parameters is obtained in advance, and the PWM table is set in a storage 302.

The PWM tables illustrated in FIG. 16 are 30/176 of the PWM tables illustrated in FIG. 12, namely, approximately one-sixth of the PWM tables illustrated in FIG. 12. Thus, the capacity of the storage 302 can be reduced to one-sixth. The configuration according to the present embodiment as above enables pixel scaling factor correction and light-quantity correction to be independently performed for each of the first beam La and the second beam Lb, with a reduction in capacity for PWM tables.

According to an embodiment of the present invention, provided is an image forming apparatus that enables inhibition of nonuniformity in image density and includes an optical scanner that forms, with a plurality of beams of laser light, an electrostatic latent image on the surface of a photoconductor, in which the spots of the plurality of beams of laser light are variable in moving velocity on the surface of the photoconductor.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2021-026293, filed Feb. 22, 2021, which is hereby incorporated by reference herein in its entirety.

What is claimed is:

1. An image forming apparatus comprising:

a photoconductor;

an optical scanner configured to cause laser light to scan on a surface of the photoconductor to form an electrostatic latent image, the optical scanner being configured to cause a plurality of beams of laser light to scan simultaneously on the surface of the photoconductor;

a pixel size calculator configured to calculate a pixel size corresponding to a scanning position of the laser light on the surface of the photoconductor;

a light-quantity value quantization converter configured to quantize a light-quantity value corresponding to the scanning position of the laser light on the surface of the photoconductor;

a storage configured to store a plurality of pieces of conversion data for conversion from image density data into a laser light driving signal;

a signal converter configured to perform, with the conversion data, conversion from the image density data into the laser light driving signal; and a selector configured to select the conversion data, according to the pixel size calculator and the light-quantity value quantization converter, wherein the optical scanner includes a light source configured to emit the plurality of beams of laser light, based on driving data obtained through conversion by a driving data converter with the conversion data selected by the selector, and the storage stores the conversion data of which a number of pieces correspond to a number resulting from a number of obtainable pixel size values×a number of obtainable light-quantity quantized values×a number of beams of the laser light.

* * * * *